US005599393A

United States Patent [19]

Elvidge et al.

[11] Patent Number: 5,599,393

[45] Date of Patent: Feb. 4, 1997

[54] METERING ROD COATERS

[75] Inventors: David R. Elvidge; Malcolm K. Smith, both of North Vancouver, Canada

[73] Assignee: MacMillan Bloedel Limited, Vancouver, Canada

[21] Appl. No.: 428,437

[22] Filed: Apr. 25, 1995

[51] Int. Cl.[6] ..... B05C 1/00

[52] U.S. Cl. ..... 118/117; 118/119; 118/126; 118/212; 118/410; 118/413; 118/419

[58] Field of Search ..... 118/117, 118, 118/119, 122, 126, 211, 212, 249, 256, 261, 262, 410, 413, 419, DIG. 15

[56] References Cited

U.S. PATENT DOCUMENTS

| | | | |
|---|---|---|---|
| 4,250,211 | 2/1981 | Damrau et al. | 427/356 |
| 4,456,637 | 6/1984 | Takeda et al. | 118/119 |
| 4,706,603 | 11/1987 | Wohlfeil | 118/410 |
| 5,078,081 | 1/1992 | Kustermann | 118/119 |
| 5,103,759 | 4/1992 | Henseler et al. | 118/118 |
| 5,179,909 | 1/1993 | Sollinger | 118/410 |

FOREIGN PATENT DOCUMENTS 2040845 10/1991 Canada .

*Primary Examiner*—Laura Edwards
*Attorney, Agent, or Firm*—C. A. Rowley

[57] ABSTRACT

A metering rod type coating applicator is provided with a metering rod having its peripheral surfaced texture to a texture in a range of Ra 0.06 to Ra 1.6 to improve the application of coating to a moving surface and permit uniform coating application using higher solids content coatings and/or lower coat weights. Preferably, the rod will be rotated at a speed significantly higher than that conventionally used and preferably with a peripheral velocity in the range of about 15 to 20 m/min.

6 Claims, 5 Drawing Sheets

METERING ROD COATERS

FIELD OF INVENTION

The present invention relates to the coater, more particularly, the present invention relates to a metering rod type coating applicator with an improved metering rod.

BACKGROUND OF THE INVENTION

The use of metering rod type coaters for applying coating, for example to the surface of a size press are well known. U.S. Pat. No 4,250,211 issued Feb. 10, 1981 to Damrau, U.S. Pat. No. 4,706,603 issued Nov. 17, 1987 to Wohlfeil and U.S. Pat. No. 5,078,081 issued Jan. 7, 1992 to Kustermann, all disclose short dwell coaters with metering rods defining one side of the main coating or metering outlet from the coating head that could be used to apply coating to a web directly onto the surface of a roll of a size press coater or the like.

It is also known to use grooved rods which have contoured peripheral surfaces and function as volumetric metering rods to meter the amount of coating applied, i.e. the surface of the rod is defined for example by winding small diameter wire helically about the rod to define the rod surface or by machining circumferential grooves formed in the rod. The diameter of the fine wire defines gaps or grooves between the convolutions of the helix. The size of these gaps as defined by the diameter of the fine wire plays a significant role in controlling the amount of coating that will be applied.

Canadian patent application 2,040,845 published Oct. 20, 1991, inventor Rantanen, discloses a rod coater that utilizes a metering rod having a very smooth peripheral surface and that is rotated contrary to the direction of movement of the coating through the coating outlet.

In all of the above described systems, uniformity of coating application may be deficient. The type of metering rod that is used i.e. grooved or smooth, imparts an upper limit to the solids content of the coating that may be properly applied.

BRIEF DESCRIPTION OF THE INVENTION

It is an object of the present invention to provide a new metering rod type coater wherein the surface of the metering rod is textured in a manner which improves coat weight uniformity and permits the application of higher solids content coatings than attainable with smooth or grooved rods.

Broadly, the present invention relates to a metering rod type coating applicator for applying coating layer on a receiving surface moving past the coating applicator, said coating applicator including a metering rod having a peripheral surface in nip forming relationship with said receiving surface, said peripheral surface of said metering rod defining one side of a coating outlet and said receiving surface defining the side of said outlet opposite said metering rod, said receiving surface moving relative to said metering rod in a direction substantially perpendicular to the longitudinal axis of said metering rod, means for biasing said metering rod substantially radially toward said receiving surface to form said nip, means for rotating said metering rod about said longitudinal axis, characterized in that said peripheral surface of said metering rod is a textured surface having a texture of a Ra value of between 0.5 μm and 1.6 μm, a Rq value of between 0.5 μm and 3 μm, a Ry value of between 1 μm and 15 μm, a Rz(DIN) value of between 3 μm and 15 μm, and a Sm value of between 30 μm and 75 μm.

Preferably, said textured surface will have a Ra of between Ra=0.5 μm and Ra=1.5 μm, most preferably, between Ra=0.7 μm and Ra =1.4 μm.

Preferably, said means to rotate rotates said rod at a peripheral velocity of 12 to 25 m/min for a rod of 35 mm in diameter with the periphery of said rod moving in the opposite direction to said receiving surface through said nip.

Preferably, said velocity will be between 15 and 20 m/min.

Preferably, said rod will have a diameter of between 25 and 5.0 mm.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Before describing the invention in detail, it is important to understand the definitions of the terms Ra, Rq, Ry, Rz(DIN) and Sm which are universally recognized symbols.

Ra is the arithmetic mean of departures of the surface profile from the mean line.

Rq is the root mean square parameter corresponding to Ra.

Ry is the largest peak to valley heights (known as the Rti values) in a sample length, i.e. Ry is the largest Rti value.

Rz(DIN) (sometimes called Rtm) is the average of the peak to valley heights, i.e. the average of the Rti values.

Sm is the mean spacing between profile peaks measured at the mean line (a profile peak is the highest part of the profile between an upward and downward crossing of the mean line).

Figure 1:
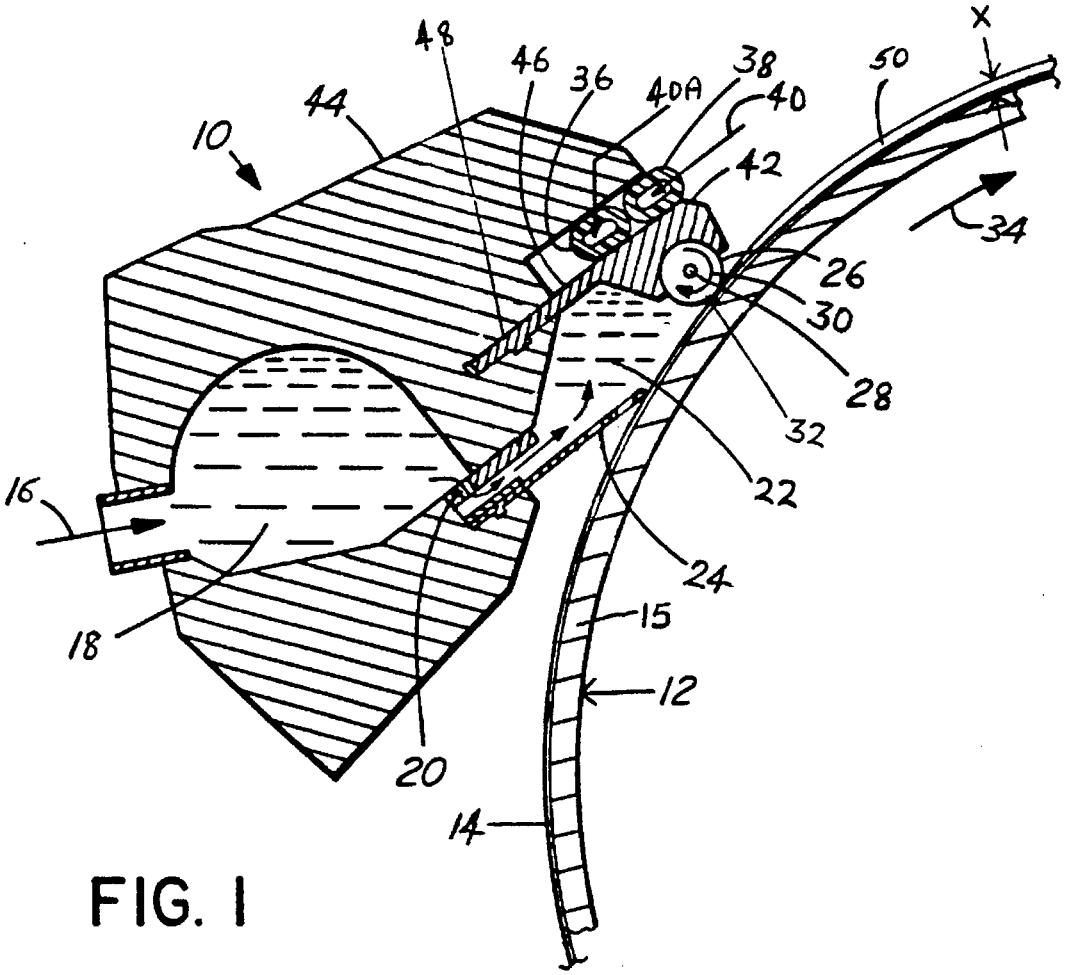
FIG. 1 is a cross section view of a typical coating applicator incorporating a metering rod mounted for application of coating to one of the rolls of a size press type coater.
Figure 2:
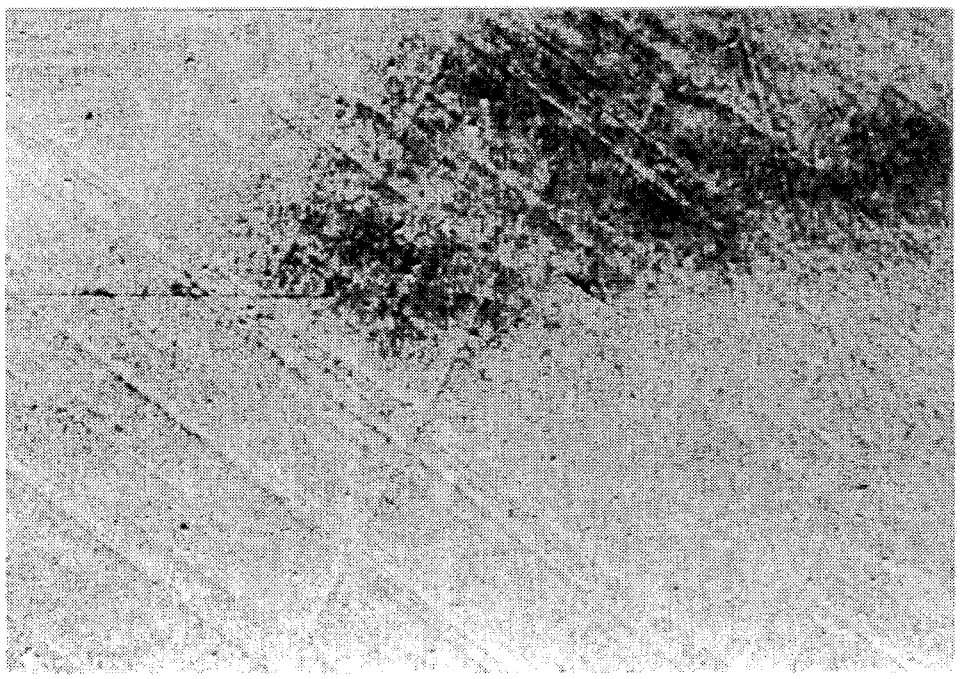
FIG. 2 is a magnified view of a portion of the surface of a smooth metering rod as used by the prior art (Ra=to 0.06 μm, Ry=0.38 μm) at 50 times magnification.
Figure 3:
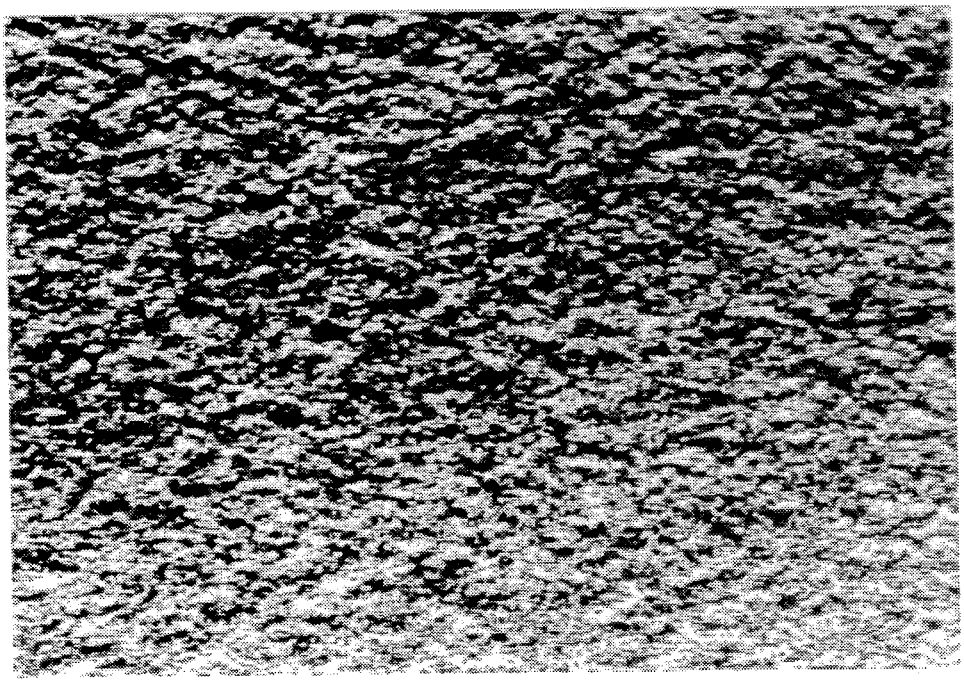
FIG. 3 is a similar view to FIG. 2 but of a medium textured rod (Ra=0.88 μm, Ry=7.1 μm) as used with the present invention at 50 times magnification having a surface finish
Figure 4:
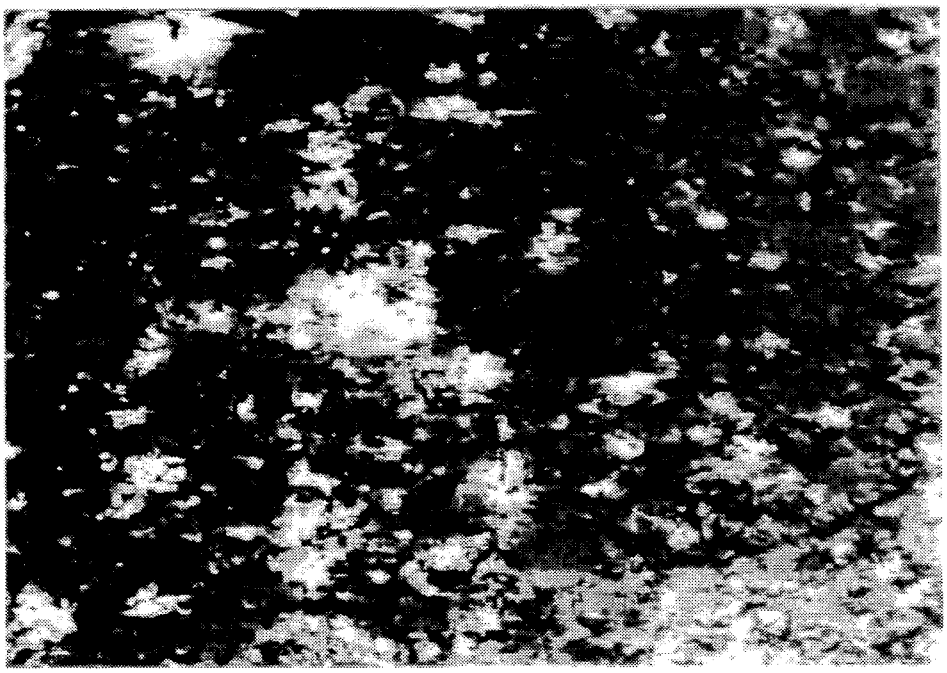
FIG. 4 is a view similar to FIG. 3 but of a rough textured metering rod with surface finish Ra=1.53 μm, Ry=10.6 μm at 50 times magnification.
Figure 5:
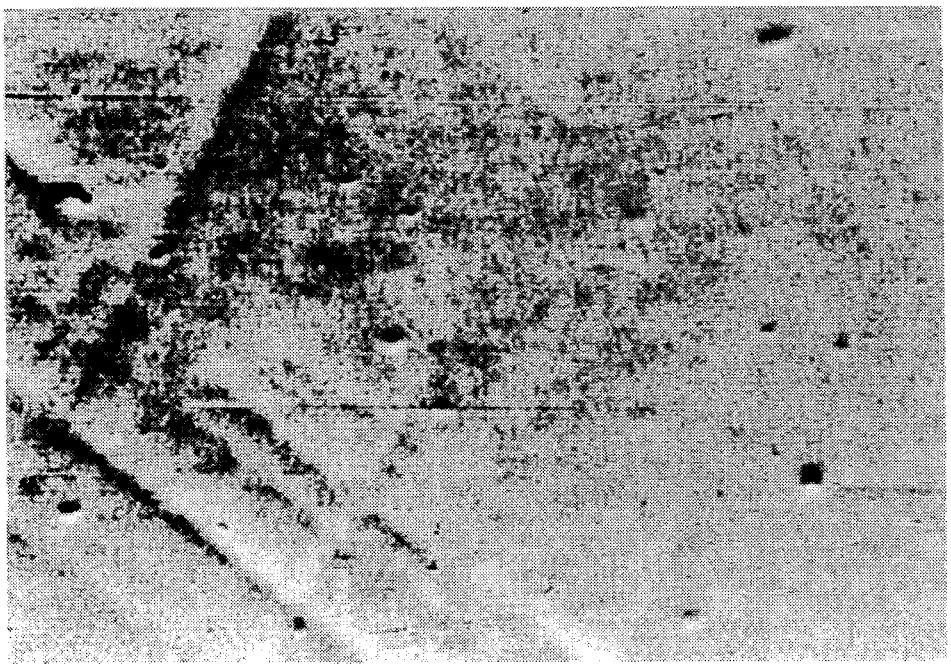
FIGS. 5, 6 and 7 are figures corresponding to FIGS. 2, 3 and 4 respectively but at 250 times magnification.
Figure 6:
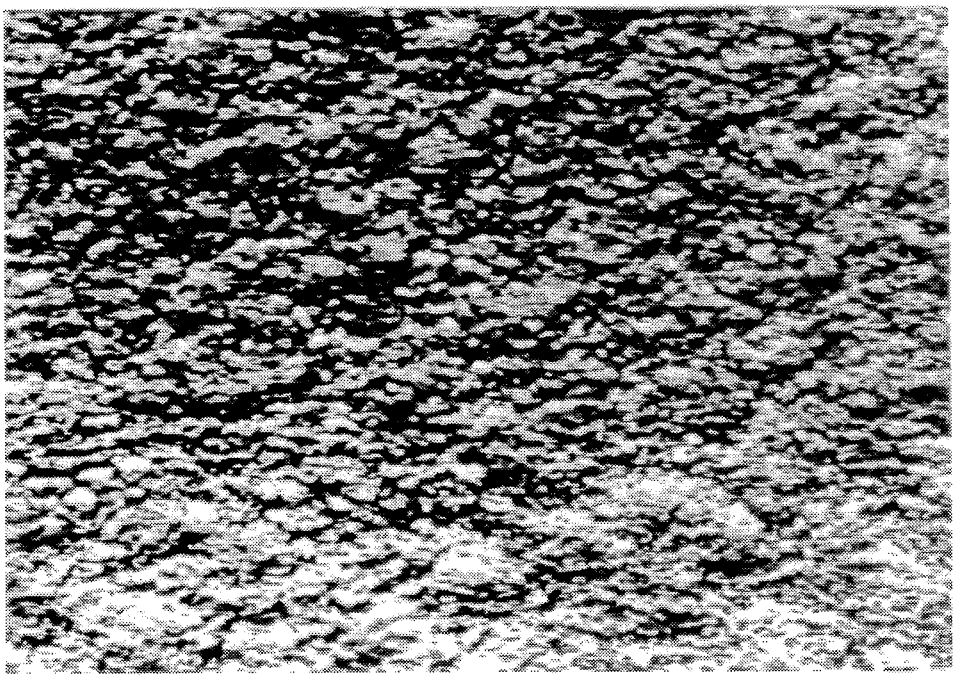
Figure 7:
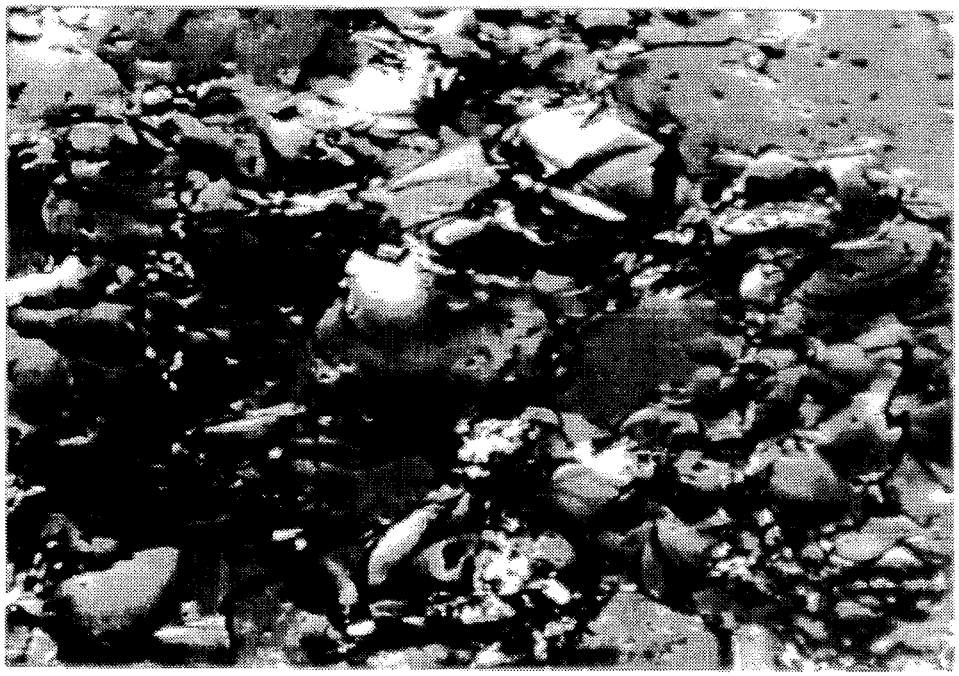
Figure 8:
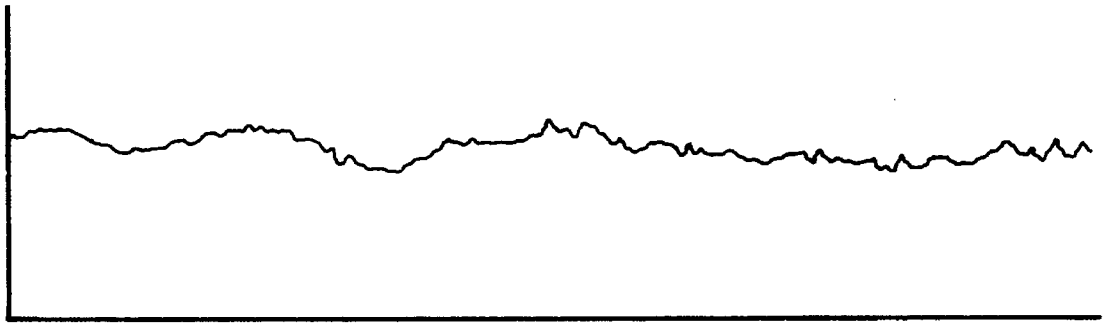
FIGS. 8, 9 and 10 are traces generated measured by stylus type instrument (Surtroic 3+).
Figure 9:
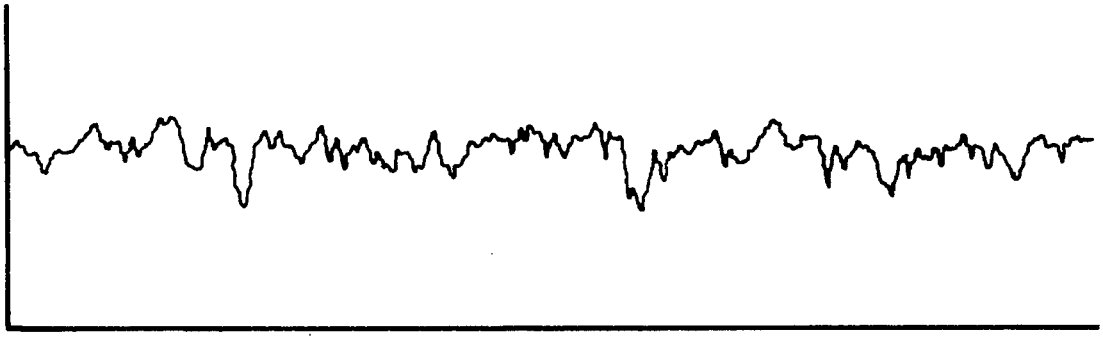
Figure 10:
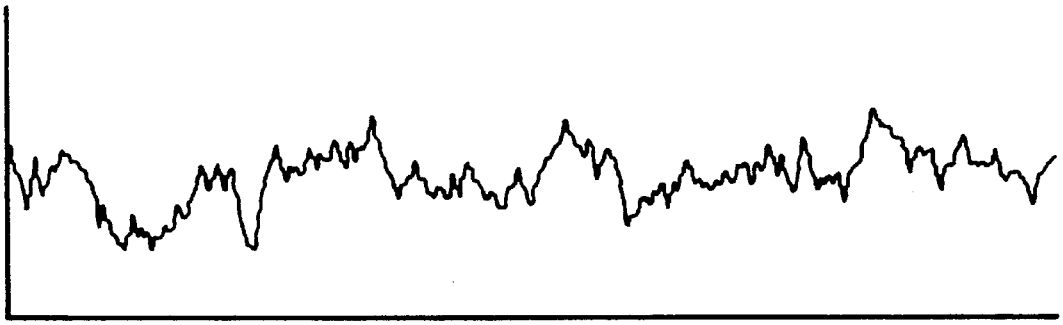

As shown in FIG. 1, the coating head 10 is being used to apply a coating to a roll 12 which is preferably one of the rolls of a size press type coater, i.e. a coater formed by a pair of size press rolls each of which is provided with its coating head 10 to apply coating to its roll which in turn transfers the coating to a web in the nip formed between the two size press rolls. Thus there will be a second head 10 applying a coating to a second roll 12 forming the cooperating portions of the size press coater. The size press rolls 12 normally have a surface cover 14 made of softer material than the shell 15 of the roll 12.

The illustrated coating applicator in 10 has an inlet 16 and a first chamber 18 which empties through holes 20 into flow chamber 22, one end (the rear end) of which is defined by a blade 24 and the opposite end (outlet end) by a rod 26 which is rotated around longitudinal axis 28 by a drive means schematically represented by the arrow 30. The rod 26 forms a nip with the surface cover 14 which nip defines the outlet 32 from the coating head 10 for applying coating to the surface cover 14 of roll 12. It will be noted that the direction of movement of the periphery of the surface cover 14 as indicated by the arrow 34 is opposite to the direction of movement of the surface of the rod 26 through the nip or outlet 32.

The cover 14 will preferably be selected to have a hardness measured by the Pusey & Jones (P&J) system of between about 20 and 100, preferably 35 and 50.

Rod 26 in the illustrated arrangement is mounted in a supporting head 42 that is mounted from the body 44 of the coater head 10 via a resilient arm 46 that has its end 48 remote from the head 42 received within a groove within the body 44. The rod 26 is biased toward the surface 14 to form the nip or outlet 32 in the illustrated arrangement by a pair of inflatable tubes 36 and 38 interposed between the body 44 and the supporting head 42. Pneumatic pressure may be applied as indicated by the arrows 40 and 40A to the tubes 36 and 38 within a reasonable range to adjust the pressure in the nip forming outlet 32 and thereby adjusting the thickness X of a coating layer 50 formed on the cover 14 and which determines the coat weight to be applied to the web.

It has been found that by texturing the surface of the periphery of the rod 26 as will be described below the coating 50 may be more uniformly applied, that coating thickness may be more accurately controlled, higher solids content coating may be satisfactorily applied and lower coat weights uniformly applied. The rough surface appears to change the rheology of the coating as it pass out through the outlet 32.

It has been found that if the texture of the surface of the rod 26 is in the ranges of Ra value of between=0.5 μm and 1.6 μm, Rq value of between 0.5 μm and 3 μm, Ry value of between 1 μm and 15 μm, Rz(DIN) value of between 3 μm and 15 μm, and Sm value of between 30 μm and 75 μm.

and the preferred hardness of the cover 14 as above described of between P&J 35 and P&J 50, improved uniformity of application of coating is obtainable and further the solids content of the coating applied may be increased and light coat weights in the order of 5 to 7 g/m$^2$ and less per side may be applied.

A medium textured surface on the rod 26, i.e. a surface having a Ra of between 0.7 and 1.4 is preferred.

As above indicated it is customary to rotate the rod 26 to move its peripheral surface in the opposite direction to the direction of movement of the cover 14 through the nip 32. Generally, for a rod 26 having the normal diameter as used in the art of between between about 25 to 50 mm the peripheral velocity of the rods is up to about 12 m/min. It has now been found that by increasing the peripheral velocity of the rod significantly to in the order of 12 to 25 m/min preferably 15 to 20 m/min, the performance of the coater may significantly be improved. When a smooth rod of the prior art is used, changing the speed of the rod has only a small effect relative to that obtained with rough rods.

Changing the diameter of the rod changes the forces applied to the coating as it passes through the outlet 32. The rod diameter normally will not exceed 50 mm and preferably is in the range of 20–40 min.

Generally the peripheral speed of the surface cover 14 of the roll 12 will be in the order of 1,000 m/min.

EXAMPLE

Tests were carried out on a pilot plant Sym-Sizer (sold by Valmet) using paper basis weight of 43 g/m$^2$ and formed from chemi-thermomechanical pulp (CTMP) with kraft fiber reinforcement and containing filler clay.

35 mm diameter metering rods, i.e. rods 26 having different textures were tested to determine the effect of different surface textures on the coating system with respect to coater effectiveness (e.g. coating uniformity, coat weight, coating solids, etc.) and coating wet film quality. Each textured rod tested with three coating solids targets (clay pigment formulation with natural and synthetic binder) were evaluated, namely:

1. 60.5% solids
2. 59% solids
3. 56.5% solids.

In these tests, the top roll of the size press coater, i.e. cover 14 of the top roll 12 had a P&J hardness of 34 and the cover 14 of the bottom roll 12 of the size press had a P&J hardness of 39, and both covers were made of polyurethene. For each solids level, the metering rod was rotated at selected speeds of 30, 150 and 225 rpm.

In all of the trials, the paper rolls were oriented so that the wire side of the sheet was coated using the lower coating roller station and the size press coater was operated at a peripheral speed of 1,070 m/minute, and a nip loading of 30 kN/m.

The effectiveness of each of the tests was ranked by visual assessment for runnability, coat film formulation, metering, operating cleanliness and ease of scraping a sample from the applicator roll surface for wet coating weight measurement. These results are presented in Table 1 with the qualitative assessment rated as 0 being the poorest and 10 the best for each rod texture at the three metering rod rotation speed.

From Table 1, it is apparent that the texture surfaced rods gave better performance than the smooth rod in the four runnability characteristics, and that in most cases, the best performance was obtained with the medium roughness rod.

Each type of rod was operated at the three coating levels, except in the case of the smooth rod wherein the highest coating solids level of 60.5 could not be run since the rod was incapable of metering down to a film thickness that would run on the Sym-Sizer while the medium and high textured rods were successful.

It is also noted that increasing the rotational speed of the smooth rods had little effect. However, increasing the speed of the medium and rough rods (diameter 35 mm) improved runnability and coater effectiveness with the best improvement being seen at a rpm of about 150 rpm (16.5 m/min peripheral speed). Increases beyond 150 rpm to 225 rpm (25 m/min peripheral speed) seemed to have little additional effect for the medium

TABLE I

| Trial Number | Coating Solids | Rod Type | Runnability and Metering Evaluations: 1 - Runnability 0 = unable, 10 = best ~30 rpm | ~150 rpm | ~225 rpm | 2 - Film Uniformity 0 = poor, 10 = best ~30 rpm | ~150 rpm | ~225 rpm |
|---|---|---|---|---|---|---|---|---|
| n/a | 60.5 | Std Ra = 0.06 | 0 | 0 | 0 | 0 | 0 | 0 |
| 95001 | 59.2 | Std Ra = 0.06 | 1 | 2 | 2 | 2 | 3 | 3 |
| 95002 | 56.6 | Std Ra = 0.06 | 7 | 8 | 8 | 4 | 5 | 5 |
| 95003 | 60.6 | Med Ra = 0.88 | 3 | 9 | 10 | 5 | 9 | 10 |
| 95004 | 59.1 | Med Ra = 0.88 | 5 | 6 | 6 | 8 | 8 | 9 |
| 95005 | 56.7 | Med Ra = 0.88 | 5 | 5 | 5 | 6 | 6 | 7 |
| 95006 | 60 | Rgh Ra = 1.53 | 5 | 6 | 6 | 4 | 5 | 5 |
| 95007 | 58.6 | Rgh Ra = 1.53 | 6 | 7 | 7 | 3 | 4 | 4 |
| 95008 | 56.7 | Rgh Ra = 1.53 | 7 | 8 | 8 | 5 | 5 | 5 |

| Trial Number | Coating Solids | Rod Type | 3 - Metering Cleanliness 0 = worst, 10 = best ~30 rpm | ~150 rpm | ~225 rpm | 4 - Ease of Scraping 0 = worse, 10 = best ~30 rpm | ~150 rpm | ~225 rpm |
|---|---|---|---|---|---|---|---|---|
| n/a | 60.5 | Std Ra = 0.06 | 0 | 0 | 0 | 0 | 0 | 0 |
| 95001 | 59.2 | Std Ra = 0.06 | 3 | 5 | 6 | 3 | 3 | 3 |
| 95002 | 56.6 | Std Ra = 0.06 | 7 | 8 | 8 | 6 | 7 | 7 |
| 95003 | 60.6 | Med Ra = 0.88 | 6 | 9 | 9 | 2 | 5 | 6 |
| 95004 | 59.1 | Med Ra = 0.88 | 9 | 10 | 10 | 6 | 7 | 7 |
| 95005 | 56.7 | Med Ra = 0.88 | 8 | 9 | 9 | 9 | 10 | 10 |
| 95006 | 60 | Rgh Ra = 1.53 | 8 | 8 | 8 | 5 | 5 | 5 |
| 95007 | 58.6 | Rgh Ra = 1.53 | 8 | 8 | 8 | 8 | 9 | 9 |
| 95008 | 56.7 | Rgh Ra = 1.53 | 9 | 10 | 10 | 4 | 5 | 5 |

NOTES:
1 - Runnability - with respect to web stealing, overall operating etc.
2 - Film Uniformity - based on appearance of wet film, tram lines, and overall uniformity
3 - Metering Cleanliness - based on buildup, stalagmites, splitting etc., in the metering area.
4 - Ease of scraping - based on ease of scraping wet coating sample from Applicator roll surface.

textured rod; for the high roughness rod effectiveness of the coater was impaired slightly.

It was also noted that with textured rods, a thin film, i.e. thickness 20 micro meters relatively small, and coat weights equivalent to 5 to 7 g/m$^2$ per side (both sides are coated in the nip of the size press coater) could be achieved even with the highest solids content coating. These applications of high solids and low coat weights could not be obtained as above described with the smooth rod of the prior art. The medium roughness rods were more suitable for metering thin film and gave the best film structure particularly at the higher rpm of 150.

To further examine the samples, they were treated by a burn out technique wherein the coated sheet is treated with acid that carbonizes the fibers and turns them black to permit easier assessment of the coating distribution. These tests reveal the most uniform coating distribution was obtained using the medium texture rod at the highest solids and higher rpm whereas the worst distribution was obtained using the rough rods at the lowest solids at the lowest rpm.

The standard, i.e. smooth rods, at 59% solids gave approximately equal coat weight per side as that obtained with the medium textured rod, however, the coating was more uniform with the medium texture rod. The rough rod gave a more grainier appearance.

"Web stealing", i.e. flapping of the web leaving the nip of the size press coater from one size press roll to the other when applying a coating particularly at higher solid. At 60% solid, web stealing was very evident at low rod rpm with all rods tested, however, it was found that the medium textured rod operated at 150 rpm (16.5 m/min peripheral speed) significantly reduced this problem.

It will be apparent by proper selecting of the texture and rpm of the rod the operation of the coating applicator may be significantly improved.

Having described the invention, modifications will be evident to those skilled in the art without departing from the scope of the invention as defined in the appended claims.

We claim:

1. A metering rod coating applicator for applying coating layer on a receiving surface moving past the coating applicator, said coating applicator comprising a body portion and a metering rod having a peripheral surface in nip forming relationship with said receiving surface, said peripheral surface of said metering rod defining one side of a coating outlet and said receiving surface defining the side of said outlet opposite said metering rod, said receiving surface moving relative to said metering rod in a direction substantially perpendicular to the longitudinal axis of said metering rod, means between said body Portion and said metering rod for biasing said metering rod toward said receiving surface to form said nip, means connected to said metering rod for rotating said metering rod about said longitudinal axis, said peripheral surface of said metering rod having a texture of a Ra value of between 0.5 μm and 1.6 μm, a Rq value of between 0.5 μm and 3 μm, a Ry value of between 1 μm and 15 μm, a Rz(DIN) value of between 3 μm and 15 μm, and a Sm value of between 30 μm and 75 μm, wherein Ra is the arithmetic mean of departures of the surface profile from the mean line, Rq is the root mean square parameter corresponding to Ra, Ry is the largest peak to valley height in a sample length, Rz(DIN) is the average of the peak to valley heights.

2. A coating applicator as defined in claim 1 wherein said peripheral surface has a Ra of between between Ra=0.7 μm and Ra=1.4 μm.

3. A coating applicator as defined in claim 1 wherein said means for rotating rotates said rod at a peripheral speed of 15 to 20 meters/minute with the periphery of said rod moving in the opposite direction to said receiving surface through said outlet.

4. A coating applicator as defined in claim 2 wherein said means for rotating rotates said rod at a peripheral speed of 15 to 20 m/min with the periphery of said rod moving in the opposite direction to said receiving surface through said outlet.

5. A coating application as defined in claim 3 wherein said rod has a diameter of between 25 and 50 mm.

6. A coating application as defined in claim 4 wherein said rod has a diameter of between 25 and 50 mm.

* * * * *